US010653968B2

(12) United States Patent
Jiang

(10) Patent No.: US 10,653,968 B2
(45) Date of Patent: May 19, 2020

(54) DYNAMIC SEAT MOVEMENT PLATFORM

(71) Applicant: Guangzhou Shuqee Digital Tech. Co., Ltd., Guangzhou, Guangdong Province (CN)

(72) Inventor: Jiacheng Jiang, Guang'an (CN)

( * ) Notice: Subject to any disclaimer, the term of this patent is extended or adjusted under 35 U.S.C. 154(b) by 0 days.

(21) Appl. No.: 16/392,944

(22) Filed: Apr. 24, 2019

(65) Prior Publication Data

US 2020/0101392 A1 Apr. 2, 2020

(30) Foreign Application Priority Data

Sep. 30, 2018 (CN) ..... 2018 2 1621050 U

(51) Int. Cl.
*A63G 31/02* (2006.01)
*A63J 25/00* (2009.01)
*A47C 1/12* (2006.01)

(52) U.S. Cl.
CPC ..... *A63G 31/02* (2013.01); *A47C 1/12* (2013.01); *A63J 25/00* (2013.01)

(58) Field of Classification Search
CPC ..... A63G 31/02; A47C 1/12; A63J 25/00; F16M 11/121; G09B 9/02
USPC ..... 472/60; 297/325
See application file for complete search history.

(56) References Cited

U.S. PATENT DOCUMENTS 5,009,412 A * 4/1991 Roodenburg ..... A63G 31/00 472/136
6,162,058 A * 12/2000 Yang ..... G09B 9/14 434/55
7,934,773 B2 * 5/2011 Boulais ..... A47C 7/002 297/217.3
9,004,921 B2 * 4/2015 Garvis ..... G09B 9/14 434/46
9,536,446 B2 * 1/2017 Vatcher ..... A63G 31/16
9,986,833 B1 * 6/2018 Reid ..... A47C 1/12
2001/0003102 A1 * 6/2001 Shiina ..... A63G 31/16 472/60
2002/0045955 A1 * 4/2002 Borta ..... G09B 9/02 700/28

(Continued)

*Primary Examiner* — Michael D Dennis
(74) *Attorney, Agent, or Firm* — Novoclaims Patent Services LLC

(57) ABSTRACT

This patent provides a dynamic seat movement platform, which comprises an upper support frame and a lower support frame, and three electric cylinders are arranged between the upper support frame and the lower support frame. At the same time, it is also provided with a first auxiliary support frame and a second auxiliary support frame. The bottom ends of the first auxiliary support frame and the second auxiliary support frames are arranged on a side of the lower support frame, wherein an end surface of the joint bearing disposed on the first auxiliary support frame is horizontally installed, and an end surface of the joint bearing disposed on the second auxiliary support frame is vertically installed. This patent can make the dynamic motion chair has features of simple structure, accurate simulation and smooth movements, fast response, characteristics of a large range of movement. It can also according to the action instruction files, cooperate with the films used to produce even smooth and precise movements, make the viewer produces in the plot of the film experience and brings viewer feel stimulation from the comprehensive multi-dimension.

5 Claims, 6 Drawing Sheets

(56) References Cited

U.S. PATENT DOCUMENTS

| | | | | |
|---|---|---|---|---|
| 2010/0205867 | A1* | 8/2010 | Park | A47C 1/12 52/8 |
| 2012/0267504 | A1* | 10/2012 | Atluri | G09B 9/12 248/419 |
| 2013/0018374 | A1* | 1/2013 | Edelhauser | A61B 17/62 606/56 |
| 2014/0290400 | A1* | 10/2014 | Choi | A63J 25/00 74/43 |
| 2015/0354747 | A1* | 12/2015 | Jennings | F16M 11/2028 248/396 |
| 2017/0009856 | A1* | 1/2017 | Choi | A47C 1/12 |
| 2019/0046888 | A1* | 2/2019 | Ausenda | A63G 31/02 |

* cited by examiner

DYNAMIC SEAT MOVEMENT PLATFORM

BACKGROUND OF THE PRESENT INVENTION

Field of Invention

The patent relates to the technical field of dynamic seat, in particular to a dynamic seat movement platform.

Description of Related Arts

Dynamic seat is a seat specially set in the dynamic cinema, which can be controlled by the computer to make different special effects according to the specific story of the film, for example, fall, shock, spray wind, spray rain, etc. Coupled with carefully designed smoke, rain, photoelectricity, bubbles, smells and so on, to create a fully sensory environment consistent with the content of the film and meet people's desire for a higher level of viewing experience when watching the film.

At present, the movement platform of the dynamic seat in the existing technology is mainly driven by ordinary hydraulic cylinder or cylinder. Among them, the more widely used is the cylinder driving mode, that is, the cylinder is installed on the bottom frame and achieve the platform up, down, tilt and other motion state through the cylinder mechanism. However, this kind of driving mode generally has such problems as complex structure, large space occupied, sluggish response, low movement stability, high failure rate and complex installation, etc., and the operation is not flexible enough, inconvenient to use, and cannot meet the needs of use.

SUMMARY OF THE PRESENT INVENTION

The embodiment of this patent provides a dynamic seat motion platform, which solves problems such as complicated structure, large space occupied, slow response, low motion stability, high failure rate and complicated installation when cylinder is driven by the existing technology.

This patent provides a dynamic seat movement platform, which comprises an upper support frame and a lower support frame, and three electric cylinders are arranged between the upper support frame and the lower support frame; At the same time, it is also provided with a first auxiliary support frame and a second auxiliary support frame. The bottom ends of the first auxiliary support frame and the second auxiliary support frames are arranged on a side of the lower support frame. Its top ends are connected to the upper support frame by joint bearing, setting on the other side of the oblique relative edge side of the upper support frame and lower support frame, wherein an end surface of the joint bearing disposed on the first auxiliary support frame is horizontally installed, and an end surface of the joint bearing disposed on the second auxiliary support frame is vertically installed.

As a preferred mode of this patent, the electric cylinder includes the first electric cylinder, the second electric cylinder and the third electric cylinder, the described three electric cylinders are triangular distribution.

As a preferred mode of this patent, the first electric cylinder is arranged in the middle position of one side of the lower support frame and is located between the first auxiliary support frame and the second auxiliary support frame, the second and the third electric cylinders are respectively arranged at two ends of the other side of the lower support frame.

As a preferred mode of this patent, both two ends of the electric cylinder are connected with the upper support frame and the lower support frame respectively through the cross universal joint.

As a preferred mode of this patent, the first auxiliary support frame and the second auxiliary support frame are provided with oblique support rods respectively, one end of the inclined support rods is arranged on the first auxiliary support frame or the second auxiliary support frame, and the other end is arranged on the other side of the lower support frame The dynamic seat motion platform provided by the embodiment of this patent has three electric cylinders disposed between the upper support frame and the lower support frame, the joint bearing of the top of the two auxiliary support frames disposed between the upper support frame and the lower support frame is horizontally installed and vertically installed respectively. So that the dynamic seat has the characteristics of simple structure, accurate simulation, smooth movement, fast response, large amplitude of movement, etc., and can be combined with the action instruction file to produce a smooth and accurate motion movement, which can make the viewers can experience the feeling in the film plot, and bring the viewers a sense of stimulation from all aspects and dimensions.

In order to more clearly illustrate the technical solutions in the embodiments of this patent, the following is a brief introduction to the figures that need to be used in the embodiment description. Obviously, that the figures in the following description are only some embodiments of this patent. For general technicians in this field, other pictures may also be obtained from these figures without paying for creative labor.

DETAILED DESCRIPTION OF THE PREFERRED EMBODIMENT

Figure 1:
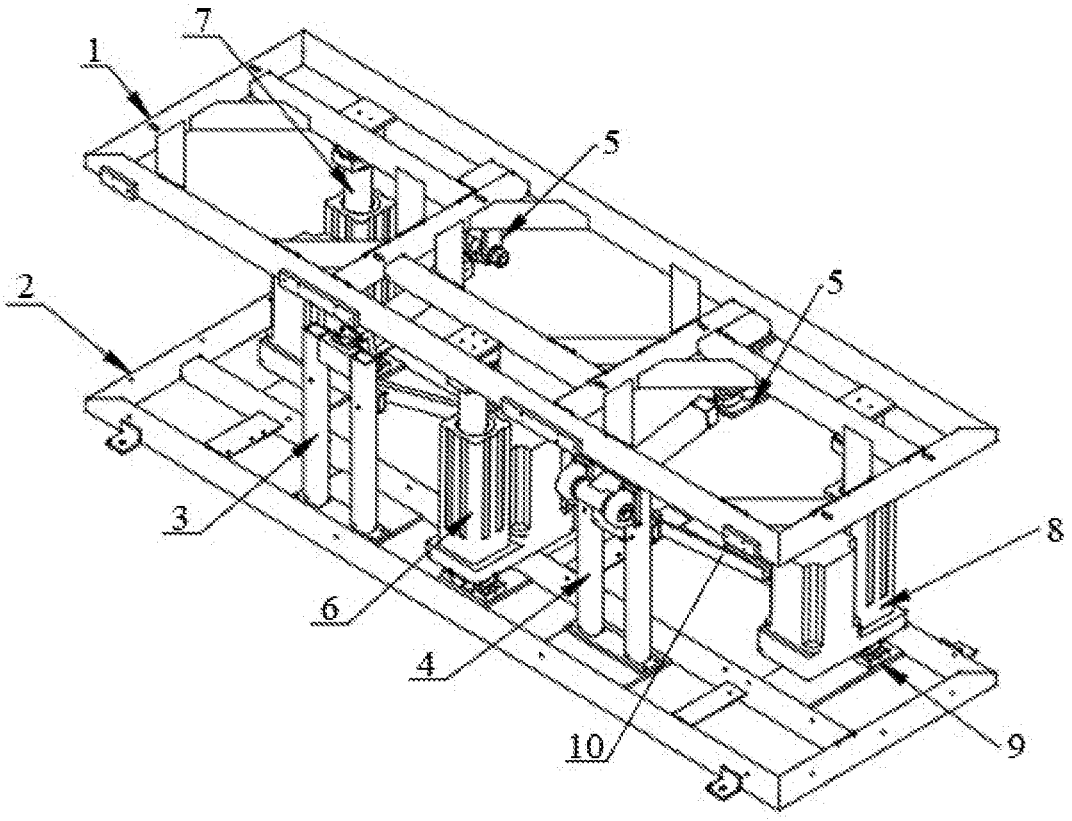
FIG. 1 is the structure diagram of a dynamic seat motion platform provided in this patent embodiment.

In order to enable people in this technical field to better understand this patent scheme, the following will be a clear and complete description of the technical scheme in the embodiment of this patent in conjunction with the figures in the embodiment of this patent, obviously, the embodiment described is only an embodiment of part of this patent, not a full embodiment. Based on the embodiment of this patent, all other embodiments obtained by ordinary technical personnel in this field without making creative labor should belong to the scope of this patent protection.

Please noted: Similar labels and letters represent similar items in the following drawings. Therefore, once an item is defined in a drawing, it does not need to be further defined and interpreted in subsequent drawings.

This patent embodiment discloses a dynamic motion chair platform, which is shown in FIG. 1 to FIG. 6, including upper support frame 1 and lower support frame 2, and there is equipped with three electric cylinders between the upper support frame 1 and lower support frame 2. It is also equipped with first auxiliary support frame 3 and second auxiliary support frame 4 between the upper support frame 1 and lower support frame 2. The bottom ends of the first auxiliary support frame 3 and the second auxiliary support frame 4 are arranged on a side of the lower support frame 2, while the top ends are connect by joint bearing 5, setting on the other side of the oblique relative edge side of the upper support frame 1 and lower support frame 2. Wherein an end surface of the joint bearing disposed 5 on the first auxiliary support frame 3 is horizontally installed, and an end surface of the joint bearing 5 disposed on the second auxiliary support frame 4.

In this embodiment, the lower support frame is a rectangular frame-shaped member welded from steel, is used to connect basis for the electric cylinder and bear the weight of the seat structure from above. The lower support frame is fixed by the foot bolt, can support the electric cylinder above it, the upper support frame, the seat installation frame and the audience on the seat.

The upper support frame is also a rectangular frame-shaped member welded from steel, install in the above of electric cylinder, first auxiliary support frame and second auxiliary support frame. The upper support frame also setting with seats, so when each electric cylinder interactions to do telescopic motion, it can drive the upper support frame and the set on it to pan, rotate, lift, forward, backward, tilt, vibration and other multi-degree of freedom movement.

Because the application of electric cylinder is more and more extensive, its maintenance is simple, safe and reliable, high control precision, low production cost. In this embodiment, an electric cylinder is used to replace the original hydraulic cylinder or cylinder, can simplify the structure, reduce the placeholder space, and its response speed is fast, can achieve high precision control.

In addition, the end section of the joint bearing arranged on the first auxiliary support frame is installed horizontally, which can realize the motion constraint of the whole dynamic seat moving platform in the horizontal direction. The end section of the joint bearing arranged on the second auxiliary support frame is installed vertically, which can realize the motion constraint of the whole dynamic seat moving platform in the vertical direction. In this way, the high precision control can be further realized, achieve the effect of precise simulation and smooth movement.

Figure 2:
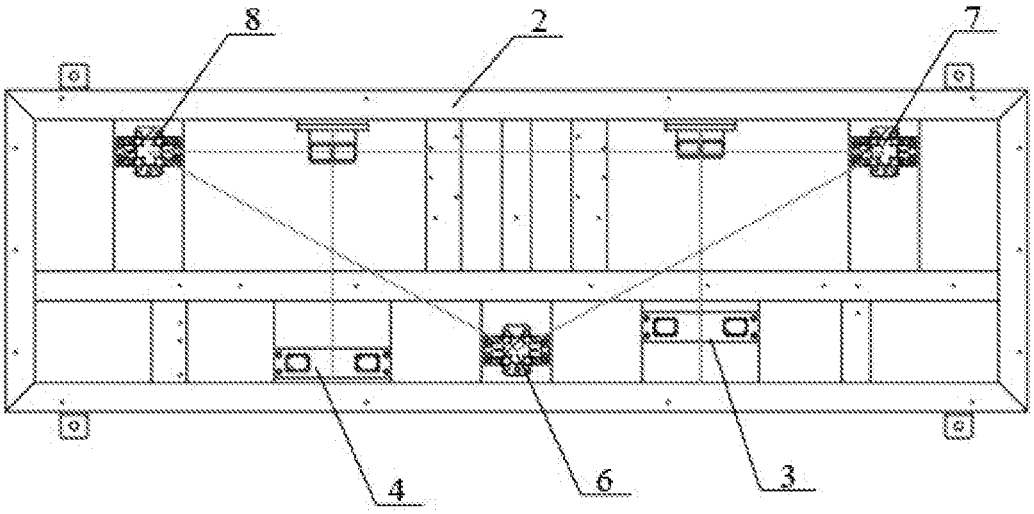
FIG. 2 is another structure diagram of a dynamic seat motion platform provided in this patent embodiment.

On the basis of the above embodiments, further reference is shown in FIG. 2, electric cylinder is including first electric cylinder 6, second electric cylinder 7 and third electric cylinder 8. The three electric cylinders are triangular distribution.

In this embodiment, a total of three electric cylinder have been set up, while the installation position of the three electric cylinders is triangular distribution, thus through the asynchronous expansion of these three electric cylinders to achieve entire dynamic motion chair platform action in different directions and different angles.

On the basis of the above embodiments, further refer to FIG. 2. First electric cylinder 6 is arranged in the middle position of a side of the support frame 2 and is located between the first auxiliary support frame 3 and the second auxiliary support frame 4, the second electric cylinder 7 and the third electric cylinder 8 are respectively set at the ends of the other side of the lower support frame 2.

In this embodiment, the first electric cylinder is arranged in the middle position of one side of the lower support frame, the second and the third electric cylinders are respectively arranged at two ends of the other side of the lower support frame, so that the installation positions of the three electric cylinders in isosceles triangle distribution, which are easier to implement the whole dynamic seat movement platform and act in different directions and different angles.

Besides, we will set the first electric cylinder between two auxiliary support frames to make the whole structure more stable.

On the basis of the above embodiment, the two sides of the electric cylinder are connected to the upper support frame 1 and the lower support frame 2 respectively through the cross universal joint 9.

In this embodiment, the two ends of the three electric cylinders are connected with the upper support frame and the lower support frame respectively through the cross universal joint, so as to make the structure of the whole dynamic seat movement platform more stable and increase its motion stability when moving at a degree of freedom.

Figure 3:
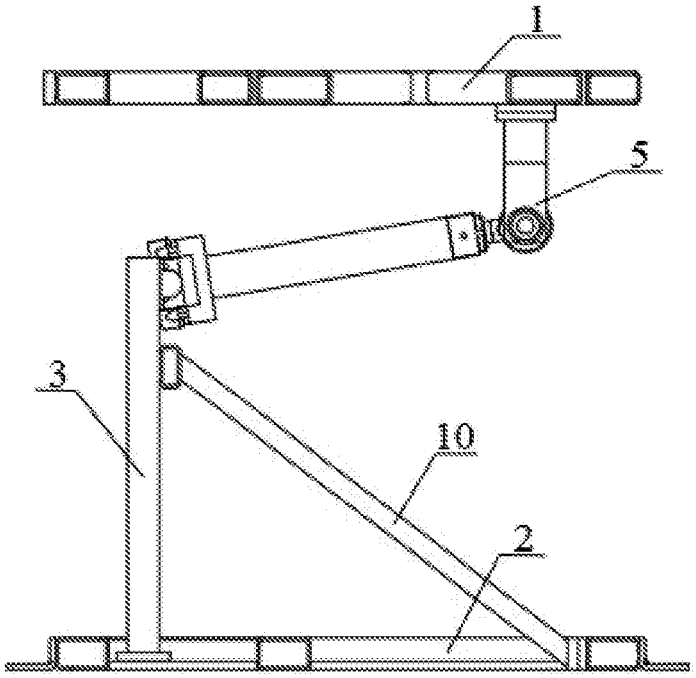
FIG. 3 is the structure diagram of the first auxiliary support frame of a dynamic seat motion platform provided in this patent embodiment.
Figure 4:
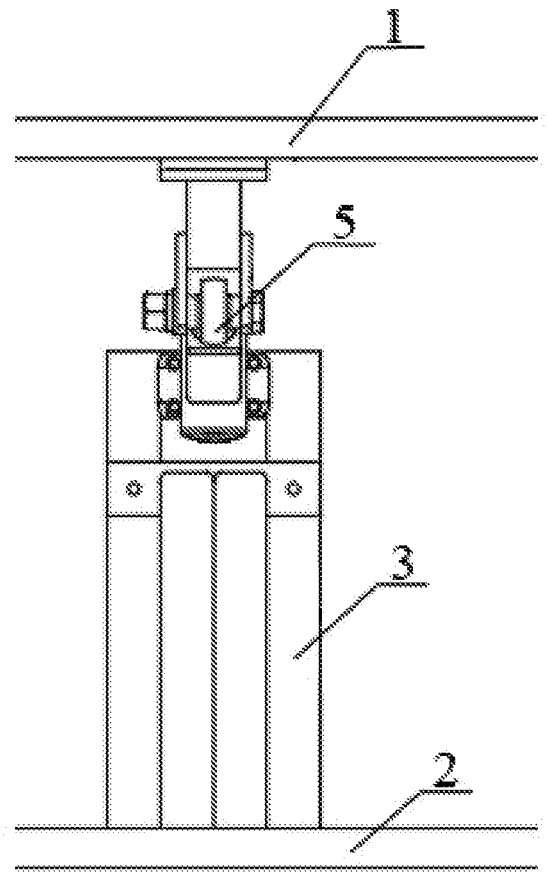
FIG. 4 is another structure diagram of the first auxiliary support frame of a dynamic seat motion platform provided in this patent embodiment.
Figure 5:
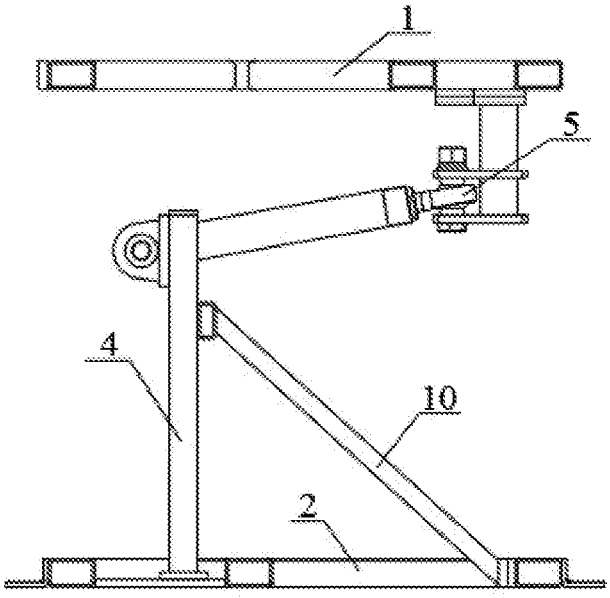
FIG. 5 is the structure diagram of the second auxiliary support frame of a dynamic seat motion platform provided in this patent embodiment.
Figure 6:
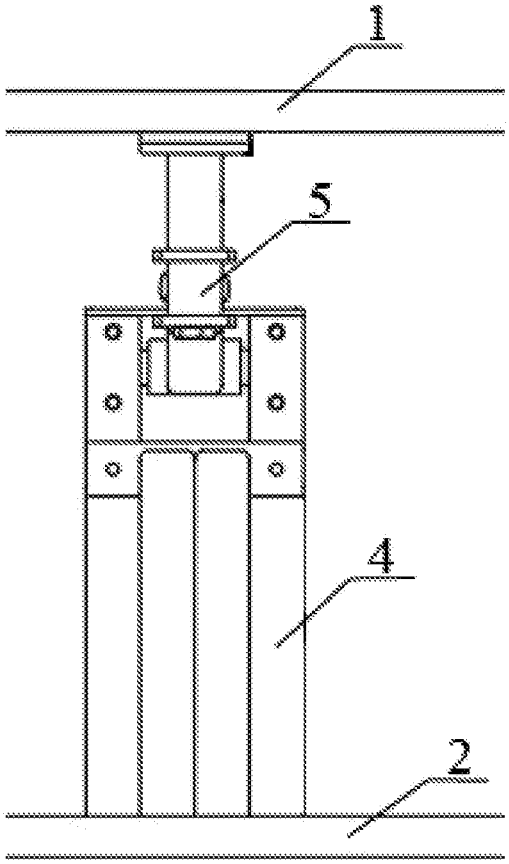
FIG. 6 is another structure diagram of the second auxiliary support frame of a dynamic seat motion platform provided in this patent embodiment.

On the basis of the above embodiment, further referring to FIG. 3 and FIG. 5, the first auxiliary support frame 3 and the second auxiliary support frame 4 are respectively set with oblique support rod 10. One end of the oblique support rod 10 is set on the first auxiliary support frame 3 or the second auxiliary support frame 4, while the other end is set on the other side of the lower support frame 2.

In this embodiment, in order to further increase the structural stability of the whole dynamic seat platform, the first auxiliary support frame and the second auxiliary support frame are provided with oblique support rods respectively, can ensure the structural and movement stability, reduce the failure rate, make the movement more smooth and accurate when the asynchronous expansion of these three electric cylinders to achieve entire dynamic motion chair platform action in different directions and different angles.

The dynamic seat motion platform provided by the embodiment of this patent has three electric cylinders disposed between the upper support frame and the lower support frame, the joint bearing of the top of the two auxiliary support frames disposed between the upper support frame and the lower support frame is horizontally installed and vertically installed respectively. So that the dynamic motion chair has features of simple structure, accurate simulation and smooth movements, fast response, characteristics of a large range of movement. It can also according to the action instruction files, cooperate with the films used to produce even smooth and precise movements, make the viewer produces in the plot of the film experience and brings viewer feel stimulation from the comprehensive multi-dimension.

In the description of this patent, it is important to note that, the orientation or position relationship of the terms "Up", "Under", "Inside", "Outside", etc., is based on the orientation or position relationship shown in the figures, or the position or orientation relationship that is routinely placed when the patented product is used. Just only to describe this patent and simplify description, rather than indicating or implying that the device or element referred to must have a particular orientation and be constructed and operated in a particular orientation, therefore, it cannot be understood as a limitation of this patent.

In addition, terms such "The first", "The second", "The third" are only used to distinguish between descriptions and cannot be understood to indicate or imply relative importance.

In the description of this patent, it is also important to note that, the terms "Setup," "Installation," "Inside," "Connect," shall be understood in a broad sense, unless otherwise expressly provided and defined. For example, it can be a fixed or a removable connection, or be connected in one place; It can be a mechanical or an electrical connection; It can be directly connected or be indirectly connected through intermediate media, also can be a connection within two components. For ordinary technicians in the field, the specific meaning of the above terms in this patent can be understood in specific circumstances.

In the above embodiment of the patent, each embodiment is described with its own emphasis, some of the sections that are not detailed in an embodiment can be found in the relevant descriptions of other embodiments.

The present invention, while illustrated and described in terms of different preferred embodiments, is not limited to the particular description contained in this specification. Additional alternative or equivalent components could also be used to practice the present invention.

What is claimed is:

1. A dynamic seat movement platform comprising an upper support frame and a lower support frame, wherein three electric cylinders are arranged between the upper support frame and the lower support frame; a first auxiliary supporting frame and a second auxiliary supporting frame positioned between the upper support frame and the lower support frame; wherein bottom ends of the first auxiliary support frame and the second auxiliary support frames are arranged on a side of the lower support frame, wherein top ends of the first auxiliary support frame and the second auxiliary support frame are connected to the upper support frame by joint bearing that extends to a side of the upper support frame opposite to the first auxiliary support frame and the second auxiliary support frame, wherein an end surface of the joint bearing disposed on the first auxiliary support frame is horizontally installed, and an end surface of the joint bearing disposed on the second auxiliary support frame is vertically installed.

2. The dynamic seat movement platform of claim 1, wherein the three electric cylinders are arranged in triangular distribution.

3. The dynamic seat movement platform of claim 2, wherein is that the first electric cylinder is arranged in a middle position of one side of the lower support frame and is located between the first auxiliary support frame and the second auxiliary support frame, the second and the third electric cylinders are respectively arranged at two ends of the other side of the lower support frame.

4. The dynamic seat movement platform of claim 1, wherein two ends of the three electric cylinders are connected with the upper support frame and the lower support frame respectively through a cross universal joint.

5. The dynamic seat movement platform of claim 1, wherein the first auxiliary support frame and the second auxiliary support frame are provided with oblique support rods respectively, one end of the support rods is arranged on the first auxiliary support frame or the second auxiliary support frame, and the other end is arranged on the other side of the lower support frame.

* * * * *